US006188173B1

(12) United States Patent
Kang et al.

(10) Patent No.: US 6,188,173 B1
(45) Date of Patent: Feb. 13, 2001

(54) CATHODE RAY TUBE

(75) Inventors: Gwang-soo Kang; Chi-heoun Song, both of Suwon-si (KR)

(73) Assignee: Samsung Display Devices Co., Ltd., Suwon-si (KR)

( * ) Notice: Under 35 U.S.C. 154(b), the term of this patent shall be extended for 0 days.

(21) Appl. No.: 09/246,255

(22) Filed: Feb. 8, 1999

(30) Foreign Application Priority Data

Sep. 19, 1998 (KR) ..... 98-38810

(51) Int. Cl.[7] ..... H01J 31/00

(52) U.S. Cl. ..... 313/477 R; 313/477; 313/472; 313/473

(58) Field of Search ..... 313/477, 477 R, 313/472, 473, 474, 475, 476

(56) References Cited

U.S. PATENT DOCUMENTS 3,731,129 5/1973 Tsuneta et al. ..... 313/64

6,002,203 * 12/1999 Yokota et al. ..... 313/477

* cited by examiner

*Primary Examiner*—Frank G. Font
*Assistant Examiner*—Roy M. Punnoose
(74) *Attorney, Agent, or Firm*—Christie, Parker, & Hale, LLP

(57) ABSTRACT

A cathode ray tube includes a rectangular panel on which a phosphor screen is formed, and a neck in which an electron gun assembly for emitting three electron beams is disposed. The cathode ray tube also has a funnel including a neck seal part at which the neck and the funnel are connected, a cone part formed contiguous to the neck seal part, and has a non-circular section having a maximum diameter along a direction other than a long axis and a short axis of the panel; and a body formed contiguous to the cone part and the panel. In the cathode ray tube, inflection points are formed between the cone part and the body, and the inflection point at a diagonal direction of the panel is formed nearer to the panel than the inflection points at the long axis and the short axis.

8 Claims, 5 Drawing Sheets

CATHODE RAY TUBE

BACKGROUND OF THE INVENTION (a) Field of the Invention

The present invention relates to a cathode ray tube (CRT) and more particularly, to a cathode ray tube capable of effectively deflecting electron beams and having increased strength against external stress.

(b) Description of the Related Art

A CRT is a device for displaying image on a screen by vertically and horizontally deflecting electron beams generated from an electron gun and landing the deflected electron beams onto the phosphor layers formed on the screen. The deflection of the electron beam is controlled by a deflection yoke mounted on an exterior surface of a funnel of the CRT and which forms vertical and horizontal magnetic fields. The CRTs are generally employed for color televisions (TVs), monitors and high definition televisions (HDTV). And with the increasing use of the CRTs, there is a need to reduce the length of the CRT for increasing the brightness of the displayed image and for reducing the size of the final products, such as TVs, monitors and HDTVs.

In a CRT with reduced length, the electron beams should be deflected with wider-angles, and the deflection frequency and current supplied to the deflection yoke should be increased for the wider-angle deflections of the electron beams. As the deflection frequency and current increases, the deflection magnetic field tends to leak to the outside of the cathode ray tube and the power consumption increases.

In order to decrease the magnetic field leakage, a compensation coil is generally mounted with the deflection yoke. When, however, the compensation coil is employed, the power consumption of the cathode ray tube more increases. Alternatively, in order to decrease the deflection power consumption and the magnetic field leakage, it is conventionally preferable to decrease the neck diameter of the cathode ray tube and the outer diameter of the funnel near the neck side on which the deflection yoke is mounted, so that the deflection field efficiently acts on the electron beams. When the neck diameter simply decreases, there are disadvantages that the resolution of the image deteriorates due to the reduced diameter of the electron gun, and the outer electron beams are likely to be bombard the inner wall of the funnel, thus results in that the bombarded electron beams are not properly landed on the phosphor layer of the screen.

In order to solve these problems, U.S. Pat. No. 3,731,129 discloses a funnel having a wider peripheral portion sealed to the periphery of the panel, and a deflection portion whose cross-sectional configuration gradually varies from a rectangular shape substantially similar to that of the rectangular image produced on the panel to a circular shape. Thereby, the vertical and horizontal coils of the deflection yoke are closely located to the passage of the electron beams, and deflect the electron beams with reduced deflection power and without bombarding the electron beams to the inner wall of the funnel.

However, if the funnel having rectangular cross-section is designed without considering the external stress, such as the external pressure exerted onto the vacuumed funnel, the funnel does not have enough strength against the compressive stress produced by external pressure exerted on the vertical and horizontal directions of the rectangular shaped funnel and against the tensile stress produced by the external pressure exerted on the diagonal directions of the rectangular shaped funnel. Thus, it is difficult to form the funnel of rectangular cross-section having enough strength to endure against the external stress.

SUMMARY OF THE INVENTION

The present invention is directed to a cathode ray tube which substantially obviates the problems of the related art mentioned above.

An object of the present invention is to provide a cathode ray tube capable of effectively deflecting electron beams, and thereby reducing the deflection power and having increased strength against external atmospheric pressure.

Another object of the present invention is to provide a cathode ray tube particularly suitable for flat-panel cathode ray tubes.

To accomplish these advantages, the cathode ray tube comprises a rectangular panel on which a phosphor screen is formed, and a neck in which an electron gun assembly for emitting three electron beams is disposed. The cathode ray tube also has a funnel including a neck seal part abutting the neck, a cone part formed contiguous to the neck seal part, and has a non-circular section having a maximum diameter along a direction other than a long axis and a short axis of the panel; and a body formed contiguous to the cone part and the panel. In the cathode ray tube, top of round (inflection points) are formed between the cone part and the body, and the inflection point at a diagonal direction of the panel is formed nearer to the panel than the inflection points at the long axis and the short axis.

The objectives and other advantages of the invention will be realized and attained by the structure particularly pointed out in the written description and claims as well as the appended drawings. It is also to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate a particular embodiment of the invention and, together with the description, serve to explain the principles of the invention. In the drawings.

DETAILED DESCRIPTION OF THE INVENTION

The preferred embodiments of the present invention will now be described with reference to the drawings.

Figure 1:
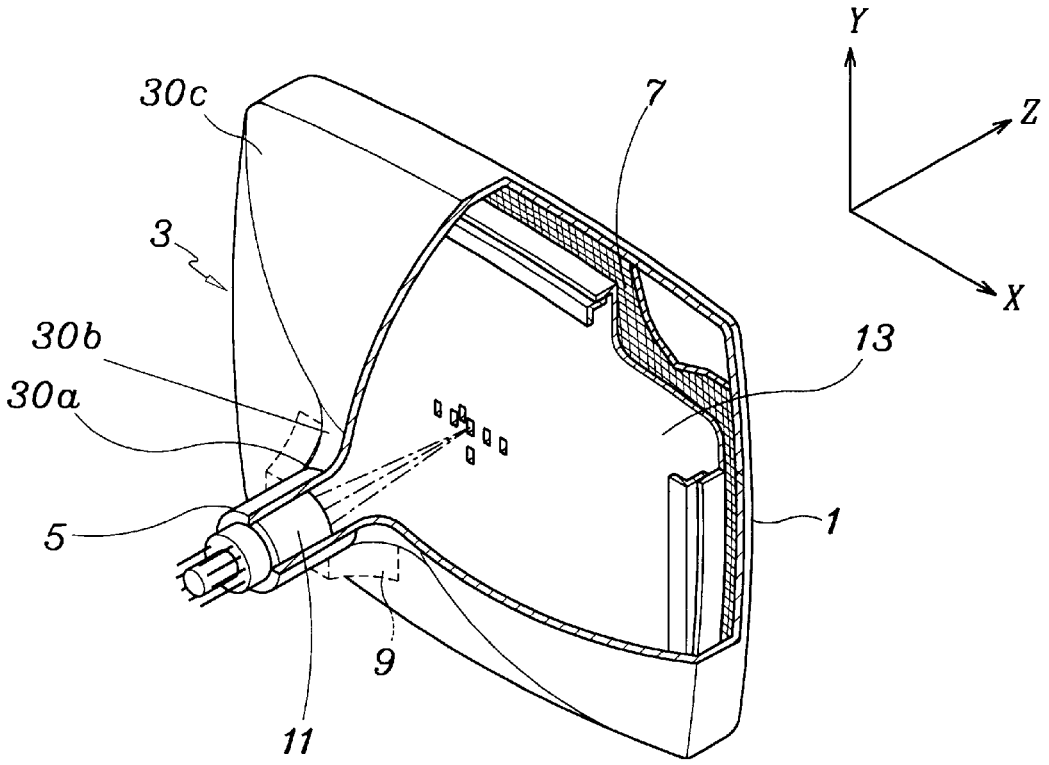
FIG. 1 is a partial sectional view of a cathode ray tube according to an embodiment of the present invention.
Figure 2:
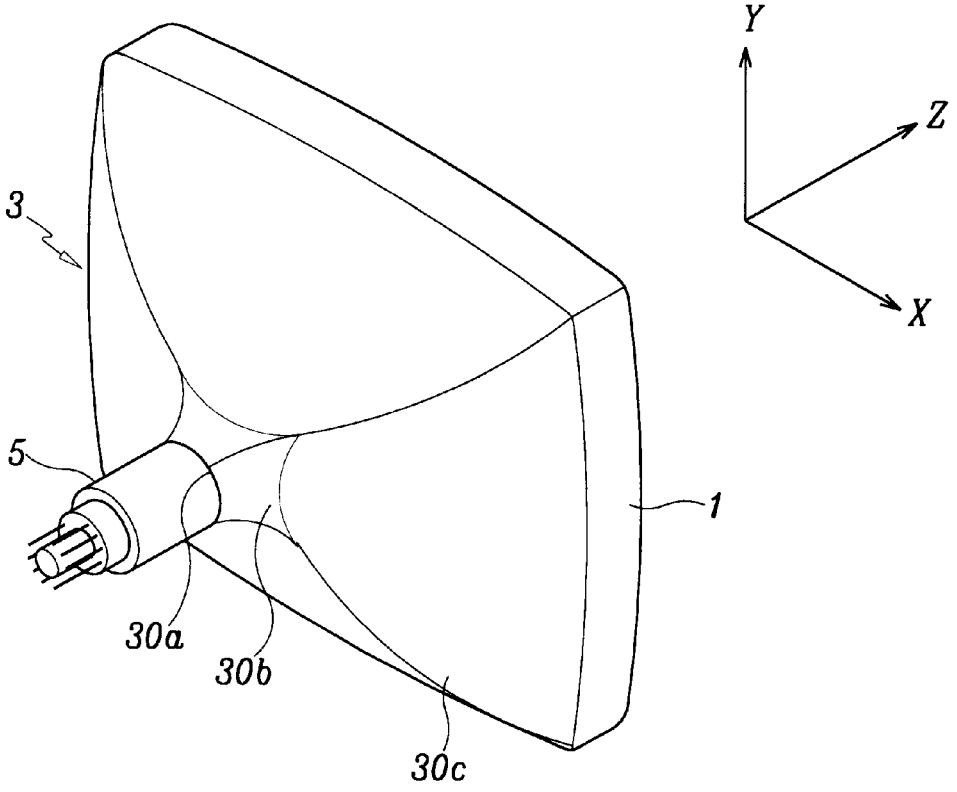
FIG. 2 is a perspective view of a cathode ray tube according to an embodiment of the present invention.

As shown in FIGS. 1 and 2, a CRT according to the present invention is comprised of a substantially rectangular panel 1, a funnel 3, and a cylindrical neck 5. The panel 1 has a long axis at the X-direction and a short axis at the Y-direction, and a phosphor screen 7 is formed on the inner surface of the panel 1. A deflection yoke 9 is mounted on the funnel 3 near the neck 5, and an electron gun assembly 11 for emitting three electron beams is disposed in the neck 5. The funnel 3 includes three parts, i.e., a neck seal part 30*a* at which the neck 5 and the funnel 3 are connected, a cone part 30*b* formed contiguous to the neck seal part 30*a*, and a body 30*c* formed contiguous to the cone part 30*b* and the panel 1.

Figure 3:
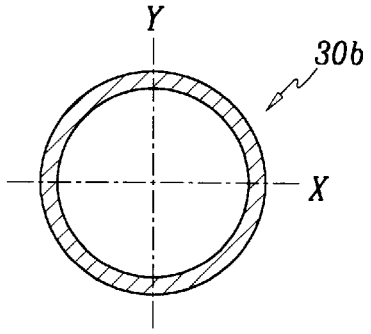
FIG. 3 is a sectional view of a cone part of a cathode ray tube according to an embodiment of the present invention, taken at the position near the neck of the cathode ray tube.
Figure 4:
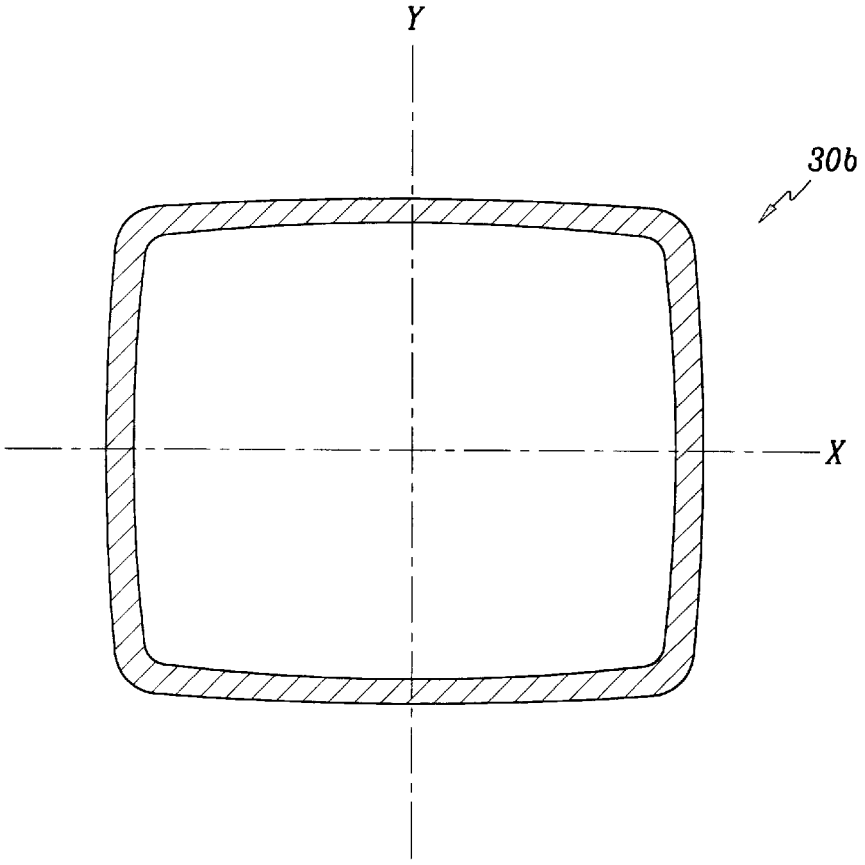
FIG. 4 is a sectional view of a cone part of a cathode ray tube according to an embodiment of the present invention, taken at the position near the panel of the cathode ray tube.

What differentiate the present invention from the prior art CRT is at the cone part 30*b* of the funnel 3, on which the deflection yoke 9 is mounted. When cut in a plane parallel with the panel surface 1, the cone part 30*b* has a circular cross section at the location where it meets the neck 5 as shown in FIG. 3. In a direction toward the panel 1, the cross sections take on a progressively non-circular shape, such as substantially rectangular one as shown in FIG. 4. This configuration of the cone part 30*b* helps to reduce power consumption of the deflection yoke 9 generating deflection electromagnetic fields. The non-circular section having a maximum diameter along a direction other than the long axis and the short axis.

The three electron beams emitted from the electron gun assembly 11 are deflected by horizontal and vertical deflection fields generated by the deflection yoke 9 in the X-direction and Y-direction, respectively. The deflected electron beams reach the phosphor screen 7 through a shadow mask 13 mounted on the inner surface of the panel 1, and display a color image.

Figure 5:
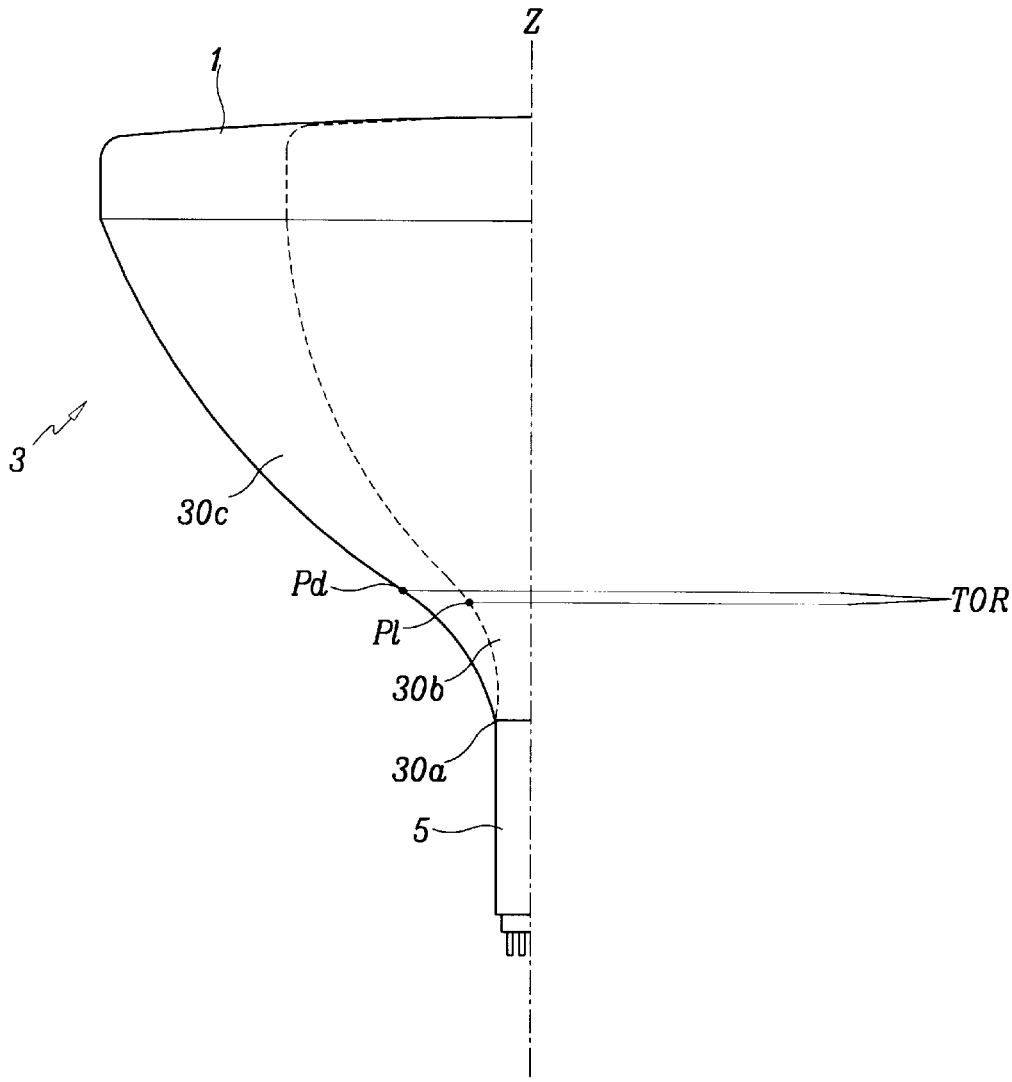
FIG. 5 is a half-side view of a cathode ray tube according to an embodiment of the present invention.
Figure 6:
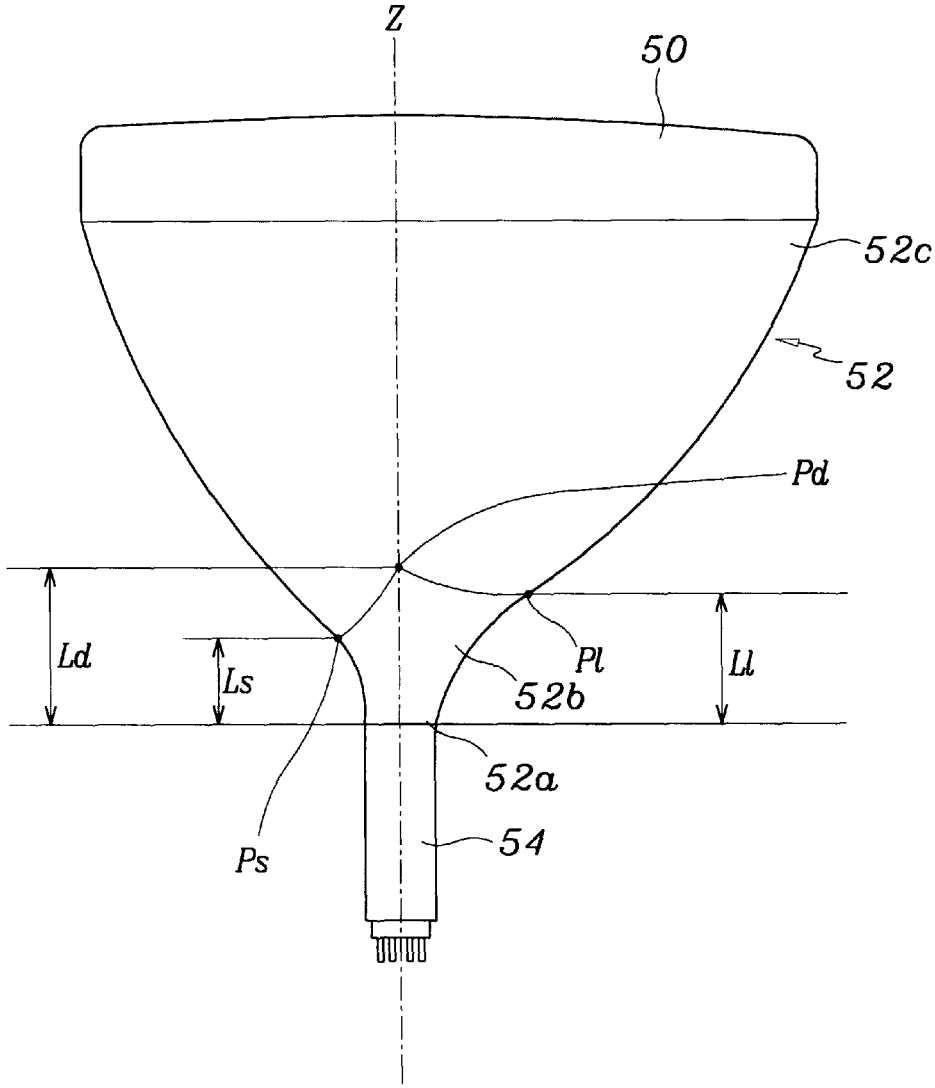
FIG. 6 is a full-side view of a cathode ray tube according to an embodiment of the present invention.

The cone part 30*b* of the present invention further meets the following conditions to increase the tube strength against external atmospheric pressure. As shown in FIG. 5, the cone part 30*b* is concaved, and the body 30*c* is convexed seen from outside, and therefore top of rounds (TOR, i.e., inflection point) are formed between the cone part 30*b* and the body 30*c*. In FIGS. 5 and 6, the top of round at the diagonal direction of the panel 1 is represented by Pd, and the top of rounds at the long axis and short axis of the panel 1 are represented by Pl and Ps, respectively. According to an embodiment of the present invention, The cone part 30*b* is formed so that the top of round at the diagonal direction (Pd) is formed nearer to the panel 1 than the top of rounds at the long axis and short axis (Pl, Ps). In FIG. 5, it is only shown that a top of round at the diagonal direction (Pd) is formed nearer to the panel 1 than a top of round at the long axis (Pl), but the top of round at the diagonal direction (Pd) should be formed nearer to the panel 1 than a not-shown top of round at the short axis (Ps).

FIG. 6 shows that the top of round at the diagonal direction (Pd) is formed nearer to the panel 1 than the top of rounds at the long axis and short axis (Pl, Ps), and the top of round at the long axis (Pl) is formed nearer to the panel 1 than the top of round at the short axis (Ps). However, alternatively, the top of round at the short axis (Ps) is formed nearer to the panel 1 than the top of round at the long axis (Pl).

Therefore, the cathode ray tube of the present invention has the cone part 30*b* of a rectangular section so as to reduce the deflection power, and the length of the cone part 30*b* at the diagonal direction Ld on which the maximum tensile stress is exerted by the external pressure increases. Thus, the tensile stress spreads or disperses on the increased length of the cone part 30*b* at the diagonal direction Ld, and thereby increase the strength of the cone part 30*b* against the external atmospheric pressure.

FIG. 6 is provided for alternative description of the present invention. As shown in FIG. 6, a cathode ray tube is formed with a substantially rectangular panel 50 on which a phosphor screen (not shown) is formed, a funnel 52 formed contiguous to the panel 50, and a cylindrical neck 54 formed contiguous to the small-diameter end portion of the funnel 52. The funnel 52 includes a neck seal part 52*a* at which the neck 54 and the funnel 52 are connected, a cone part 52*b* formed contiguous to the neck seal part 52*a*, and a body 52*c* formed contiguous to the cone part 52*b* and the panel 50. The cone part 52*b* has a circular section at the neck side, and the circular section is gradually deformed from the neck side to the panel side to have a rectangular section, thereby to reduce the deflection power, and the top of rounds are formed at the end of the cone part 52*b* at which the body 52*c* is connected.

In order to reduce the deflection power and increase strength of the cathode ray tube against external stress, the cone part 52*b* is formed to meet the following condition.

$$Ld > Ll \geqq Ls$$

In above-condition, Ld represents a projected distance on the tube axis (Z) of the distance between the neck seal part 52*a* and the position at which the cone part 52*b* and body 52*c* meet at the diagonal direction of panel 50, and Ll and Ls represent projected distances on the tube axis (Z) of the distances between the neck seal part 52*a* and the position at which the cone part 52*b* and body 52*c* meet at the long and short directions of panel 50, respectively. Therefore, the cone part 52*b* is formed so that the top of round at the diagonal direction (Pd) is formed nearer to the panel 1 than the top of rounds at the long axis and short axis (Pl, Ps), and the top of round at the long axis (Pl) is formed nearer to the panel 1 than the top of round at the short axis (Ps).

Alternatively, the cone part 52*b* can be formed so that the following condition is fulfilled.

$$Ld > Ls > Ll$$

In above condition, the cone part 52*b* is formed so that the top of round at the diagonal direction (Pd) is formed nearer to the panel 1 than the top of rounds at the long axis and short axis (Pl, Ps), and the top of round at the short axis (Ps) is formed nearer to the panel 1 than the top of round at the long axis (Pl).

The cathode ray tube according to the present invention includes conepart 52*b* having a rectangular section, thereby is capable of reducing the deflection power. In addition, the length of the cone part 52*b* at the diagonal direction increases to disperse the tensile force produced by the external pressure, thereby reducing the tensile stress on the cone part 52*b*.

The strengths of the cathode ray tubes with various configuration of the cone part 52*b* were tested, and results are shown in the following table.

TABLE

| Test No. | 1 | 2 | 3 | 4 |
|---|---|---|---|---|
| Ld:Ll:Ls | 1:1:1 | 1.1:1:1 | 1.1:1.02:1.0 | 1.1:1.0:1.02 |
| Tensile Stress | 100% | 92.1% | 92.3% | 92.5% |

As shown in Table, when the top of rounds at the diagonal direction are formed nearer to the panel than the top of rounds at the long axis and short axis (Ld>Ls, Ll), the tensile stress on the cone part 52*b* is reduced.

It will be apparent to those skilled in the art that various modifications and variations can be made in the present invention without departing from the spirit or scope of the invention. Thus, it is intended that the present invention cover modifications and variations of this invention provided they come within the scope of the appended claims and their equivalents. This application is based on application No. 98-38810 filed in Korean Industrial Property Office on Sep. 19, 1998, the content of which is incorporated herein by reference.

What is claimed is:

1. A cathode ray tube comprising:

a substantially rectangular panel having a phosphor screen;

a neck having an electron gun assembly disposed therein for emitting three electron beams and a funnel including a neck seal part abutting the neck, a cone part contiguous to the neck seal part and having a non-circular cross-section with a maximum diameter along a direction other than a long axis and a short axis of the panel, and a body formed contiguous to the cone part and the panel, wherein inflection points are formed between the cone part and the body, and the inflection point at a diagonal direction of the panel is formed closer to the panel than the inflection points at the long axis and the short axis.

2. The cathode ray tube of claim 1, wherein the inflection point at the long axis is formed nearer to the panel than the inflection point at the short axis.

3. The cathode ray tube of claim 1, wherein the inflection point at the short axis is formed nearer to the panel than the inflection point at the long axis.

4. The cathode ray tube of claim 1, wherein the inflection points at the long axis and the short axis are formed at the same distance from the panel.

5. A cathode ray tube, comprising:

a substantially rectangular panel having a phosphor screen;

a neck having an electron gun assembly disposed therein for emitting three electron beams; and a funnel including a neck seal part abutting the neck, a cone part contiguous to the neck seal part and having a non-circular cross-section with a maximum diameter along a direction other than a horizontal axis or a vertical axis of the panel, and a body having a first end contiguous to the cone part by a plurality of inflection points and a second end contiguous to the panel, the inflection points comprising a diagonal set of inflection points defining a line parallel to a diagonal direction of the panel, a horizontal set of inflection points defining a line parallel to the horizontal axis, and a vertical set of inflection points defining a line parallel to the vertical axis, said diagonal set of inflection points being closer to the panel than the horizontal and vertical sets of inflection points.

6. The cathode ray tube of claim 5 wherein the horizontal set of inflection points are closer to the panel than the vertical set of inflection points.

7. The cathode ray tube of claim 5 wherein the vertical set of inflection points are closer to the panel than the horizontal set of inflection points.

8. The cathode ray tube of claim 5 wherein the horizontal and vertical set of inflection points are substantially at the same distance from the panel.

* * * * *